US005437252A

United States Patent [19]

Glover

[11] Patent Number: 5,437,252

[45] Date of Patent: Aug. 1, 1995

[54] ROTARY PLUG

[75] Inventor: Stephen Glover, Rueil Malmaison, France

[73] Assignee: Institut Francais Du Petrole, Rueil Malmaison, France

[21] Appl. No.: 246,616

[22] Filed: May 20, 1994

[30] Foreign Application Priority Data

May 21, 1993 [FR] France ..... 93 06278

[51] Int. Cl.[6] ..... F01L 7/02

[52] U.S. Cl. ..... 123/190.2; 123/190.1

[58] Field of Search ..... 123/190.1, 190.2, 190.6

[56] References Cited

U.S. PATENT DOCUMENTS

| | | | |
|---|---|---|---|
| 4,022,178 | 5/1977 | Cross et al. | 123/190.1 |
| 4,739,737 | 4/1988 | Kruger | 123/190.1 |
| 4,782,801 | 11/1988 | Ficht et al. | 123/190.8 |
| 5,052,349 | 10/1991 | Buelna | 123/190.6 |
| 5,109,814 | 5/1992 | Coates | 123/190.1 |
| 5,152,259 | 10/1992 | Bell | 123/190.1 |

FOREIGN PATENT DOCUMENTS

| | | |
|---|---|---|
| 456777 | 9/1913 | France . |
| 2679970 | 2/1993 | France . |
| 83/00530 | 2/1983 | WIPO . |

*Primary Examiner*—Henry C. Yuen
*Assistant Examiner*—Erick Solis
*Attorney, Agent, or Firm*—Antonelli, Terry, Stout & Kraus

[57] ABSTRACT

A substantially cylindrical rotary plug for enabling admission of a fluid in a combustion chamber of an internal-combustion engine, including a least one bent inner channel through which the fluid flows, with each channel having an inlet port located on the lateral face of the plug, an outlet port to he cylindrical surface of the rotary plug, and a bend for holding back heavier constituents of the fluid under an effect of a centrifugal force. A thickness of a wall of the rotary plug between an outer face of the channel and an outside of the rotary plug is relatively thin at the level of the bend. At least one of the outlet ports of at least one of the channels and at least one of the bends to the same cross-section of the rotary plug.

9 Claims, 2 Drawing Sheets

1
2
3
4
11
11'
12
12'
1'
20
21
21'
30
40
3'
δ2
δ3
II
III
IV
V

ROTARY PLUG

FIELD OF THE INVENTION

The present invention relates to a rotary plug for transferring a fluid between a source of fluid and a combustion chamber of an internal-combustion engine, including at least a substantially cylindrical surface and a lateral face.

The present invention relates more particularly to a rotary plug for controlling the admission of gas, notably of an air-fuel mixture, in a combustion chamber of an engine, including an intrinsic seal system.

The present invention may be applied to two-stroke or four-stroke internal-combustion engines having one or several cylinders supplied with gas, notably an air-fuel mixture.

BACKGROUND OF THE INVENTION

The delivery of a carbureted mixture in the combustion chamber may be achieved, as it is known in the art, through parts moving in a reciprocating motion such as valves. A system of this type is protected by the applicant in French patent application FR-2,655,653.

However, engine performances may be limited by valve injection systems, notably concerning the control of the start and the end of the injection, and the valve area for the carbureted air (oscillation problems).

Furthermore, these systems must be mounted in cylinder heads of relatively large size. One improvement consists in using rotary plugs for the control and the delivery of a carbureted mixture.

French patent application FR-2,662,214 thus proposes the use of rotary plugs for controlling the pneumatic injection of fuel in a two-stroke engine.

The plugs disclosed have an axis of rotation located in a plane perpendicular to the axis of the cylinder, they are pierced with a transverse channel communicating the inlet pipe and the combustion chamber, and connected to driving means allowing them to be rotated according to the rotating speed of the engine crankshaft.

Compared with valves, such plugs can thus work at higher speeds and allow a higher flexibility as for the injection adjustment.

However, seal problems remain, notably at the plug inlet.

Seal devices are sometimes provided to that effect, either upstream or downstream from each plug, or in both places.

Patent application FR-2,559,208 relates to a plug for controlling the escape and/or the admission of gas from and/or towards a combustion chamber and onto which one or several seal devices are applied. The improvement envisaged in this prior art consists of a lubrication and of a cooling of the surface of contact between the seal device(s) and the plug.

It is not certain that this system is perfectly reliable, notably as far as sealing is concerned, because of the sophistication thereof.

Patent application FR-2,679,960 mentions a plug for which sealing at the inlet is provided by the shape and the lay-out of a channel pierced in the plug.

More precisely, this plug includes at least one channel through which the fluid flows, having one inlet port and one outlet port, the inlet port belongs to the lateral surface of the plug and is located at a distance, which is not zero, from the axis of rotation of the plug, whereas the outlet port belongs to the cylindrical surface of the plug and is radially offset with respect to the inlet port.

The delivery channel disclosed by this prior art includes an intrinsic fuel trapping means consisting of a bend formed by the channel and likely to hold back the fuel under the effect of the centrifugal force generated by the rotation of the rotary plug.

SUMMARY OF THE INVENTION

The present invention relates to an improvement brought to this latter type of plug.

In fact, the present invention relates to a rotary plug with an intrinsic seal which also allows an improved heat exchange with the surrounding elements.

It notably appeared that the intrinsic-seal plug according to the prior art exhibits hot zones in which thermal stresses likely to generate deformations of the plug develop.

The optimization of the heat exchange obtained according to the invention therefore allows to decrease in the thermal stresses, and also taken advantage of the heating of certain zones in order to heat the fuel present near the hot zone (s). This heating, while causing a fuel vaporization, allows a better preparation of the carbureted mixture. This mixture is thus partly homogenized before it is introduced into the combustion chamber.

The advantages and improvements which have been stated are notably obtained with a substantially cylindrical rotary plug intended for the admission of a fluid in a combustion chamber of an internal-combustion engine, including at least one bent inner channel through which the fluid flows, each channel having an inlet port located on the lateral face of the plug and an outlet port belonging to the cylindrical surface of the plug, the thickness of the wall of the plug between the outer face of the channel and the outside of the plug being very thin at the level of the bend.

According to the invention, at least one of the outlet ports of at least one of the inner channels and at least one bend belong to the same cross-section of the plug.

Advantageously, at least one of said bends of at least one of said channels is so located that its exterior curve faces the intake port of the cylinder head during the combustion phase.

According to the invention, the profile of the channel is such that the mixture first runs through the plug in a substantially longitudinal flow and flows out in a substantially radial direction.

According to an embodiment, the channel exhibits successively two bends, with the first bend being intended to reverse the substantially longitudinal direction of flow and the second bend being intended to have a radial flow at the outlet.

The rotary plug preferably includes two channels arranged symmetrically with respect to an axial plane.

The zone of the channel located close to the channel inlet has at least one stronly inclined face in order to direct the mixture efficiently towards the inside of the plug.

BRIEF DESCRIPTION OF THE DRAWINGS

Other features and advantages of the invention will be clear from reading the description hereafter, given by way of non limitative examples, with reference to the accompanying drawings in which.

DESCRIPTION OF THE PREFERRED EMBODIMENTS

Figures 1, 2, 3, 4, 5:
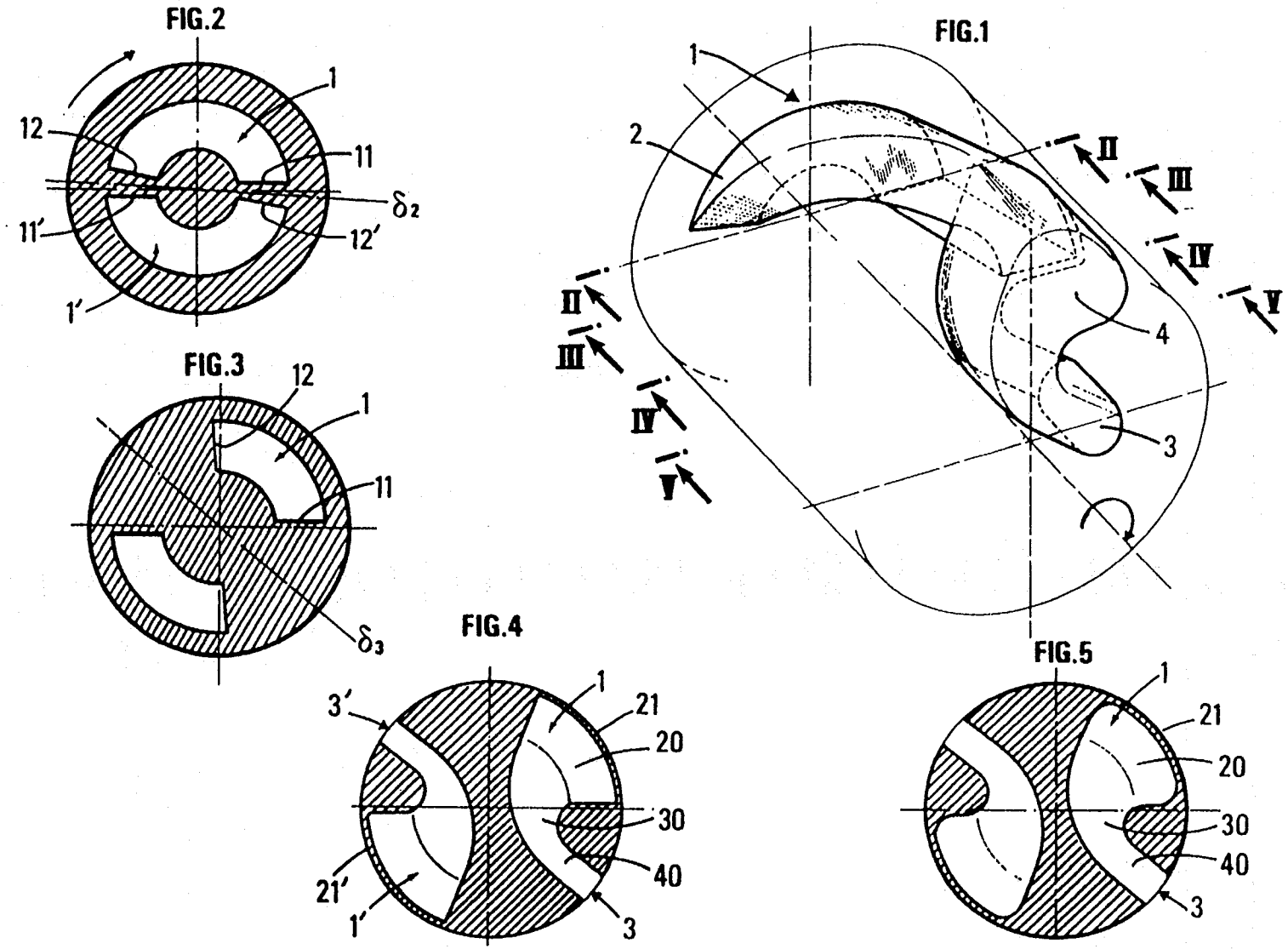
FIG. 1 is an exploded perspective showing an embodiment of a rotary plug of the invention.
FIGS. 2, 3, 4 and 5 are cross-sections taken along respectively, the linear II—II, III—III, IV—IV and V—V, in FIG. 1.

In FIG. 1, a single inner channel 1 is shown, mainly for reasons of clarity. The rotary plug according to the invention preferably has two identical channels, arranged symmetrically with respect to an axial plane of the plug.

Each channel may comprise, as it is known in the art, a mixture inlet port 2 belonging to the lateral surface and an outlet port 3 belonging to the cylindrical surface of the rotary plug.

Close to inlet port 2, the channel is substantially oriented parallel to the longitudinal axis. Close to outlet port 3, the channel is preferably oriented radially.

Each channel advantageously has at least one bend 4, the thickness of the wall at the at least one level of the bend 4 being relatively thin.

The bend 4 exhibits a concavity turned towards the outside of the plug so as to form, under the effect of the centrifugal force, a retention pocket 20 for the heavier constituent (s) of the mixture.

This distinctive feature may be obtained with the channel geometry shown in FIG. 1 and detailed in the sections of FIGS. 2 to 5.

FIG. 2, which illustrates a section close to the inlet of the plug, shows two half-ring shaped channels 1 and 1' arranged symmetrically with respect to the axial plane 2.

FIG. 3 is a section which is little different from that of FIG. 2. The plane of symmetry δ 38, (FIG. 3) has turned a little with respect to the plane of symmetry δ 28 (FIG. 2). Each channel is therefore twisted between sections of FIGS. 2 and 3. The orientation of one of the faces 11, 11' of each channel did not change, while the other face 12, 12' delimits an angle of smaller aperture. Consequently, between sections of FIGS. 2 and 3, the surface of each channel defined by faces 12, 12' is strongly inclined. This feature allows the fluid to be better directed inside each channel.

It may also be noticed that, between sections of FIGS. 2 and 3, the thickness of the wall between the outer face of each channel 1, 1' and the outer surface of the plug has substantially decreased.

FIG. 4 shows, for each channel 1, 1', a retention pocket 20, 20', an intermediate zone 30, 30' and a mixture outlet zone 40, 40'.

FIG. 5, which corresponds to a section close to the bottom of each channel, looks like FIG. 4. The following comments are valid for each of FIGS. 4 and 5.

It may notably be seen in FIGS. 4 and 5 that the wall 21 close to retention pocket 20 is very thin. This allows, as it has already been stated, promotion of the heat exchange between the outside of the plug and the fuel present inside the pocket. Pocket 20 is therefore preferably passed before the intake port of the combustion chamber during the combustion, i.e. at the hottest time of the cycle. This allows the fuel present near the walls of pocket 20 to be heated. Besides, this heat exchange cools wall 21.

The intermediate zone 30, 30' of each channel consists of a narrowing of pocket 20, 20' which ends in the substantially tubular outlet zone 40, 40'. The axis of the tubular zone 40, 40' is preferably radial in order to promote the speed of the fluid at the outlet.

The flow of the fluid through the channel according to the invention is thus the following. The fluid enters each channel through the inlet port 2 located on the lateral face of the plug and, because of the inclination mentioned above, it is rapidly directed towards the inside of the channel. The fluid then transits according to a path which is substantially parallel to the longitudinal axis of the plug, the thickness of the wall of the channel becoming increasingly thin as the fluid runs through the plug.

The fluid then meets with a semispherical bottom which imparts a first change in direction thereto, almost at 180°. This first change in direction is followed by a second one produced by the wall of the channel. This second change in direction gives an almost radial orientation to the channel at the level of its outlet 3 towards the combustion chamber.

The almost radial orientation of the outlet zone of the channel 40, 40' allows a good injection in the combustion chamber.

Besides, the outlet zone 40, 40' of the channel and the retention pocket 20, 20' being preferably located longitudinally at the same level in the plug, the retention pocket can face, at a certain phase of the working cycle, the intake port, i.e. the combustion chamber.

The direction of rotation such as it is shown in FIGS. 1 to 5 is an example according to which the outlet port 3 of a channel first faces the intake port of the combustion chamber, then the pocket 20 of this channel passes before the same port according to the direction of rotation shown in FIGS. 1 to 5.

According to this example, the carbureted mixture is thus first injected into the combustion chamber (intake phase), then, some degrees C.A. later, pocket 20 gets opposite the intake port. The combustion occurs at this time (or has just occurred), so that a great mass of energy is released from the combustion chamber. Part of this energy may thus be transmitted to pocket 20. Transmission is all the more considerable since the thickness of the wall of the plug is thin in this zone.

Consequently, the fuel (for example) which is trapped in this pocket 20 under the effect of the centrifugal force is heated as it passes before the intake port. This heat exchange promotes a vaporization of the fuel in the air, i.e. an improvement of the preparation of the mixture before it enters the combustion chamber.

Furthermore, the therms are thus advantageously collected by the fuel, so that the wall 21 of the plug never undergoes a overheating likely to damage it.

Of course, since each channel 1, 1' passes successively before the intake port, what has been stated for one channel also applies to the other channel.

In another example which is not shown, the plug rotates in the opposite direction to that shown in FIGS. 1 to 5. In this case, after the injection in the cylinder through an outlet port 3 of a channel 1, the pocket 20' of the other channel 1' comes opposite the intake port during the combustion. This other embodiment of the invention leaves more time for leading the fuel into the plug in order to take advantage of the fuel preheating effect, of the fuel vaporization aid and of the cooling of the wall.

Another embodiment of the invention, illustrated by FIGS. 6 to 9, also allows the above-stated features to be obtained.

Figure 6:
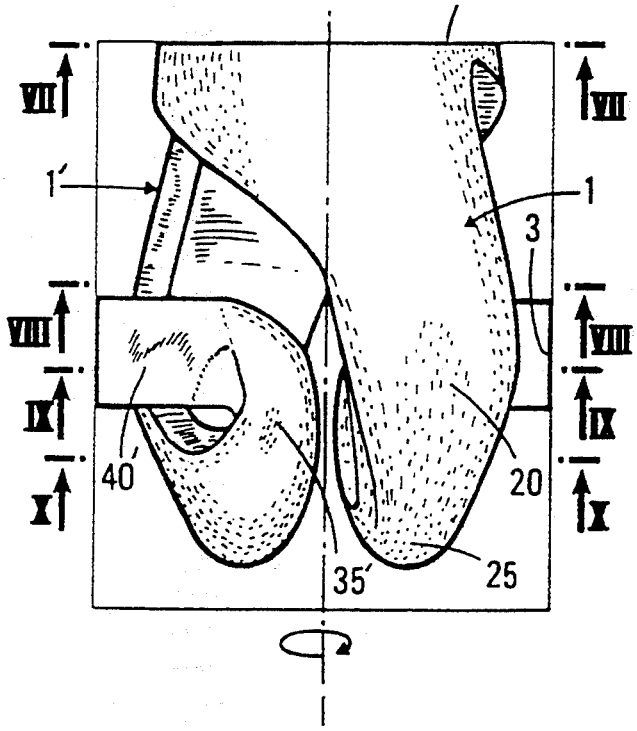
FIG. 6 is a perspective showing the geometry of the channels according to another embodiment of the invention.

FIG. 6 diagrammatically shows the geometry of channels 1, 1' and their positioning in a plug according to another embodiment of the invention.

For each channel considered, the following preferred elements are common to the previous embodiment of the invention:

A retention pocket 20, 20' and an outlet 3, 3' located substantially in a single lateral plane; the thin thickness of wall 21, 21' at the level of the pocket; a streamlined channel inlet to promote the penetration of the fluid; an outlet zone 40, 40' oriented substantially radially.

The cross-sections of FIGS. 7, 8, 9 and 10 allow the geometry of each channel to be better understood. As in the previous embodiment, two channels, symmetrical with respect to an axial plane, are provided.

The differences with respect to the previous embodiment of the invention mainly concern the bottom of each channel, which describes here a hairpin-shaped bend 25 generating a change in the direction of flow of the fluid. Besides, a connection zone 35 is provided between bend 25 and the radial outlet zone 40.

The fluid first flows substantially longitudinally through each channel 1, then an inversion of the direction occurs before the radially oriented outlet.

Figure 7:
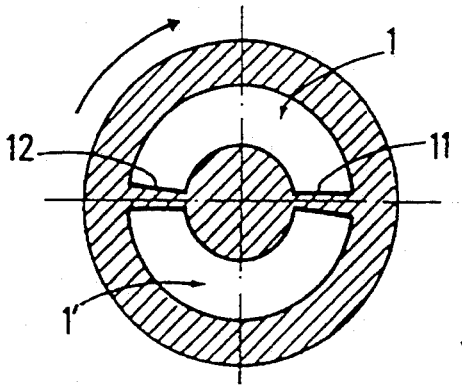
FIGS. 7, 8, 9 and 10 are cross-sections taken along the lines along VII—VII, VIII—VIII, IX—IX and, X—X, respectively, in FIG. 6.
Figure 8:
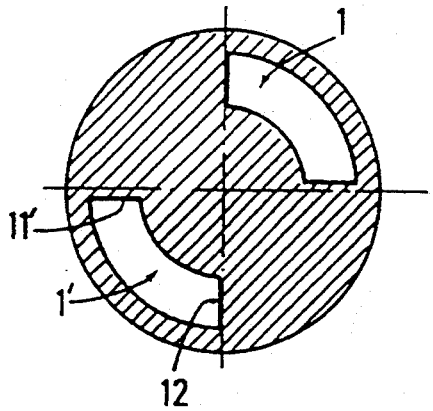

FIGS. 7 and 8 show the change of geometry from inlet VII down to the level VIII of FIG. 6. This change will not be described any further since it has already been explained for the previous embodiment.

Figure 9:
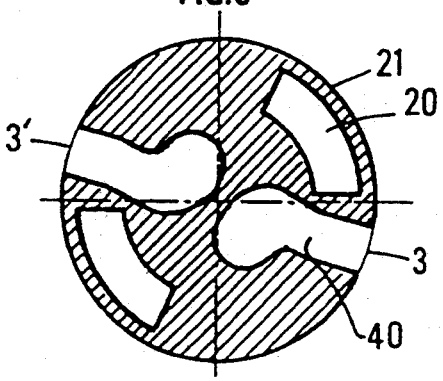

FIG. 9 shows a cross-section along IX in FIG. 6 and pocket 20, the radial outlet zone 40 and the outlet port 3 are disposed in the same cross-section.

Figure 10:
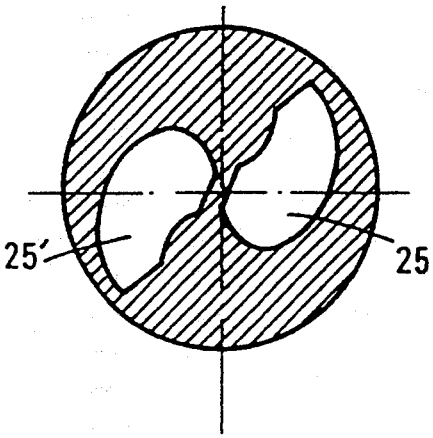

Finally, FIG. 10, which relates to cross-section X, rather shows the hairpin-shaped bottom 25, 25' of each channel.

This geometry will be preferably selected when improved aerodynamics of the inner channel and/or an improved flow are desired.

Of course, other modifications and improvements may be provided by the man skilled in the art without departing from the scope of the present invention.

I claim:

1. A substantially cylindrical rotary plug for admitting fluid in a combustion chamber of an internal-combustion engine, the rotary plug including a least one bent inner channel through which said fluid flows, each channel having an inlet port located on a lateral face of said rotary plug, an outlet port arranged at a cylindrical surface of said rotary plug, and a bend for holding back heavier constituents of the fluid under an effect of centrifugal force, wherein a thickness of a wall of the rotary plug between an outer face of the channel and an outside of the rotary plug is relatively thin at a level of said bend, and wherein at least one of the outlet ports of at least one of said channels and at least one of said bends are arranged in the same cross-section of the rotary plug.

2. A rotary plug as claimed in claim 1, wherein at least one of said bends of at least one of said channels is so located that an exterior curve thereof faces an intake port of a cylinder head of the internal combustion engine during a combustion phase.

3. A rotary plug as claimed in claim 1, wherein a profile of each channel is such that the fluid first runs through the rotary plug in a substantially longitudinal flow, then flows out in a substantially radial direction.

4. A rotary plug as claimed in claim 1, wherein the rotary plug includes two bent inner channels arranged symmetrically with respect to an axial plane.

5. A rotary plug as claimed in claim 1, wherein a zone of the channel located close to an inlet of the channel has at least one strongly inclined face to efficiently direct a fluid mixture inside the rotary plug.

6. A substantially cylindrical rotary plug for admitting a fluid in a combustion chamber of an internal-combustion engine, the rotary plug including at least one bent inner channel through which said fluid flows, each channel having an inlet port located on a lateral face of said rotary plug, an outlet port arranged at a cylindrical surface of said rotary plug, and a bend for holding back heavier constituents of the fluid under an effect of centrifical force, wherein a thickness of a wall of the rotary plug between an outer face of the channel and an outside of the rotary plug is relatively thin at level of said bend, at least one of the outlet ports of at least one of said channels and at least of said bends are arranged in the same cross-section of the rotary plug, and wherein each channel includes successively two bends, the first bend reversing a substantially longitudinal direction of flow of the fluid, and the second bend obtaining a substantially radial flow at the outlet port.

7. A rotary plug as claimed in claim 6, wherein at least one of said bends of at least one of said channels is so located that an exterior curve thereof faces an intake port of a cylinder head of the internal combustion engine during a combustion phase.

8. A rotary plug as claimed in claim 6, wherein the rotary plug includes two bent inner channels arranged symmetrically with respect to an axial plane.

9. A rotary plug as claimed in claim 6, wherein a zone of the channel located close to an inlet of the channel has at least one strongly inclined face to efficiently direct a fluid mixture inside the rotary plug.

* * * * *